United States Patent [19]

Güpner et al.

[11] 4,321,067

[45] Mar. 23, 1982

[54] CORONA-DISCHARGE ELECTRODE SYSTEM

[75] Inventors: Otto Güpner, Offenbach; Walter Steuernagel, Frankfurt am Main, both of Fed. Rep. of Germany

[73] Assignee: Metallgesellschaft Aktiengesellschaft, Frankfurt am Main, Fed. Rep. of Germany

[21] Appl. No.: 215,152

[22] Filed: Dec. 11, 1980

[30] Foreign Application Priority Data

Dec. 11, 1979 [DE] Fed. Rep. of Germany ..... 2949722

[51] Int. Cl.[3] ..... B03C 3/08; B03C 3/86

[52] U.S. Cl. ..... 55/135; 55/143; 55/145; 55/146; 55/147; 55/148

[58] Field of Search ..... 55/11, 101, 113, 135–137, 55/143, 145–148, 435, 523

[56] References Cited

U.S. PATENT DOCUMENTS

| | | | |
|---|---|---|---|
| 1,469,275 | 10/1923 | Möller et al. | 55/147 |
| 1,798,964 | 3/1931 | Wintermute et al. | 55/147 |
| 2,532,734 | 12/1950 | Schmidt | 55/148 |
| 3,327,456 | 6/1967 | Guber, Jr. et al. | 55/435 |
| 4,202,674 | 5/1980 | Rodenberger et al. | 55/146 |

FOREIGN PATENT DOCUMENTS

| | | | |
|---|---|---|---|
| 2755059 | 6/1979 | Fed. Rep. of Germany | 55/135 |
| 462637 | 3/1937 | United Kingdom | 55/147 |
| 277991 | 10/1970 | U.S.S.R. | 55/146 |

*Primary Examiner*—David L. Lacey
*Attorney, Agent, or Firm*—Karl F. Ross

[57] ABSTRACT

An electrostatic precipitator for operation at elevated pressures and temperatures comprises an inclined duct, usually of circular cross section, having the collector electrodes extending parallel to the axis of the duct and thus also inclined to the horizontal whereby the collected material can flow downwardly by gravity. The corona discharge electrodes, however, extend between frames spanned across the flow cross section and lying substantially in vertical planes, being tensioned by weights, advantageously via eccentric means such as levers.

9 Claims, 9 Drawing Figures

CORONA-DISCHARGE ELECTRODE SYSTEM

FIELD OF THE INVENTION

Our present invention relates to a corona-discharge electrode system for a high-temperature, high-pressure electrostatic precipitator and, more particularly, to an electrostatic precipitator of the type which comprises a circular section housing inclined upwardly at an angle of 50 to 70 degrees from the horizontal and including at least one array of vertical plate-like collecting electrodes, which extend substantially throughout the gas-flow area.

BACKGROUND OF THE INVENTION

Because electrostatic precipitators of this type are operated under high pressures of around 3 to 30 bars and at high temperatures of about 300° to 1200° C., structural problems and problems with materials are encountered. Satisfactory solutions to these problems have not been made apparent prior to our work in this field.

For instance, the precipitator housings at least of industrial electrostatic precipitators must be circular in cross-section for reasons of strength, and it is desired much more than in other electrostatic precipitators to utilize the gas-flow area as fully as possible for the installation of corona discharge and collecting electrodes. For this reason, the precipitator housing is upwardly inclined at such an angle that the collected dust can be automatically discharged by gravity.

For this purpose the flow behavior of the dust under the operating conditions must be known. Such an arrangement will eliminate the need for installed dust conveyors which anyway would be operative only with restrictions in such precipitators.

The shape of the precipitator housing, its upwardly inclined position and the high pressures and temperatures necessitate special designs of the collecting and corona-discharge electrodes. The corona discharge electrodes must be suspended so as to be electrically insulated from the housing and must be spaced equal distances apart from the collecting electrodes everywhere so that the electrostatic field which is built up will result in a most effective collection of dust.

For this purpose it is essential to stress mechanically the corona-discharge electrodes, which have only a small cross section to enable them to satisfy their electrical functions. Whereas only the weight of the collector electrodes must be considered in their design, internal mechanical stresses must be allowed for in the design of corona-discharge electrode systems.

This gives rise to additional difficulties because the material from which such electrodes are made has only a relatively low strength at the high operating temperatures.

OBJECTS OF THE INVENTION

It is an important object of the invention to provide a corona-discharge electrode system which operates satisfactorily and effectively under the design and operating conditions stated.

Yet another object is to provide an electrostatic precipitator of long life and high reliability in operation because such precipitators are used only in large and expensive plants so that it is essential to minimize the standstill times.

Another object of the invention is to provide an improved electrostatic precipitator and especially a corona-discharge electrode system therefor which is reliable, of simple and economic construction and is free from disadvantages found in prior-art systems.

SUMMARY OF THE INVENTION

These objects and others which will become apparent hereinafter are attained, in accordance with the present invention, in an electrostatic precipitator operating at high temperatures and pressures, preferably temperatures of 300° to 1200° C. and pressures of 3 to 30 bars, which comprises an elongated upwardly inclined round-section housing defining a gas-flow duct which is provided with at least one array of substantially vertical plate-like collecting electrodes extending through the duct over a dust-collecting region thereof.

According to the invention, a pair of grid-like frames flank the array of collecting electrodes and are spaced apart in the gas flow direction, each frame comprising at least two horizontal main carriers or bars and a plurality of vertical auxiliary carriers or bars.

Each frame is held in the duct by means of a carrying structure for each frame and each carrying structure in turn comprises a pair of vertical carriers and two inclined carriers extending out of the plane of the vertical carriers. The carriers are suspended in the duct by insulators advantageously disposed at the top of the housing so that the angle between the inclined carriers and the vertical carriers is such that tension forces upon the corona-discharge electrodes can be taken up without a rigid connection between the frames.

The corona-discharge electrodes are formed as wire-like members parallel to the direction of gas flow and are secured to the downstream upper auxiliary carriers and pass over the upstream lower auxiliary carriers and tensioned by weights.

Advantageously, the weights have centers of mass which are eccentric with respect to the points at which the wire electrodes engage the lower auxiliary carriers.

For example, the weights may have centers of mass offset from the centers of pulleys over which the wire electrodes are guided. Alternatively, the weights may form part of a lever system anchored to the wire electrodes. For example, the lever system may comprise a bell-cranking lever, one arm of which is connected to a corona electrode wire while the other arm is formed with the weight. In another alternative, the lever itself may be pivoted or fulcrumed at one end to the lower auxiliary carrier while its other end engages the corona electrode, the center of mass being located between these ends so as to tension the wires.

In yet another alternative, using a lever approach with a mass eccentric to the fulcrum, a pulley forms the weight on a free end of the lever arm and the corona-discharge wire electrode passes around this pulley to be anchored at another location to the lever or at the fulcrum or even elsewhere on the frame of which the lower auxiliary carrier forms a part.

The weight may also be formed as an eccentric, i.e. a generally round body which bears upon the corona discharge wire electrode or about which this electrode is guided, or a more complex arrangement which may be provided whereby the wire electrode passes between a pair of pins on a weighting lever.

According to yet another feature of the invention, the frames and carrying structure are composed of hollow (tubular) members of circular or other cross section through which a cooling fluid is circulated.

The weighting means, comprising levers and/or eccentric members and/or pulleys, are advantageously composed of a ceramic material so as to be highly refractory and practically unaffected by elevated temperatures.

It has also been found to be advantageous to coat the frames and carrying structure with a heat-insulating coating or covering.

BRIEF DESCRIPTION OF THE DRAWING

The above and other objects, features and advantages will become more readily apparent from the following description, reference being made to the accompanying drawing in which.

SPECIFIC DESCRIPTION

Figure 1:
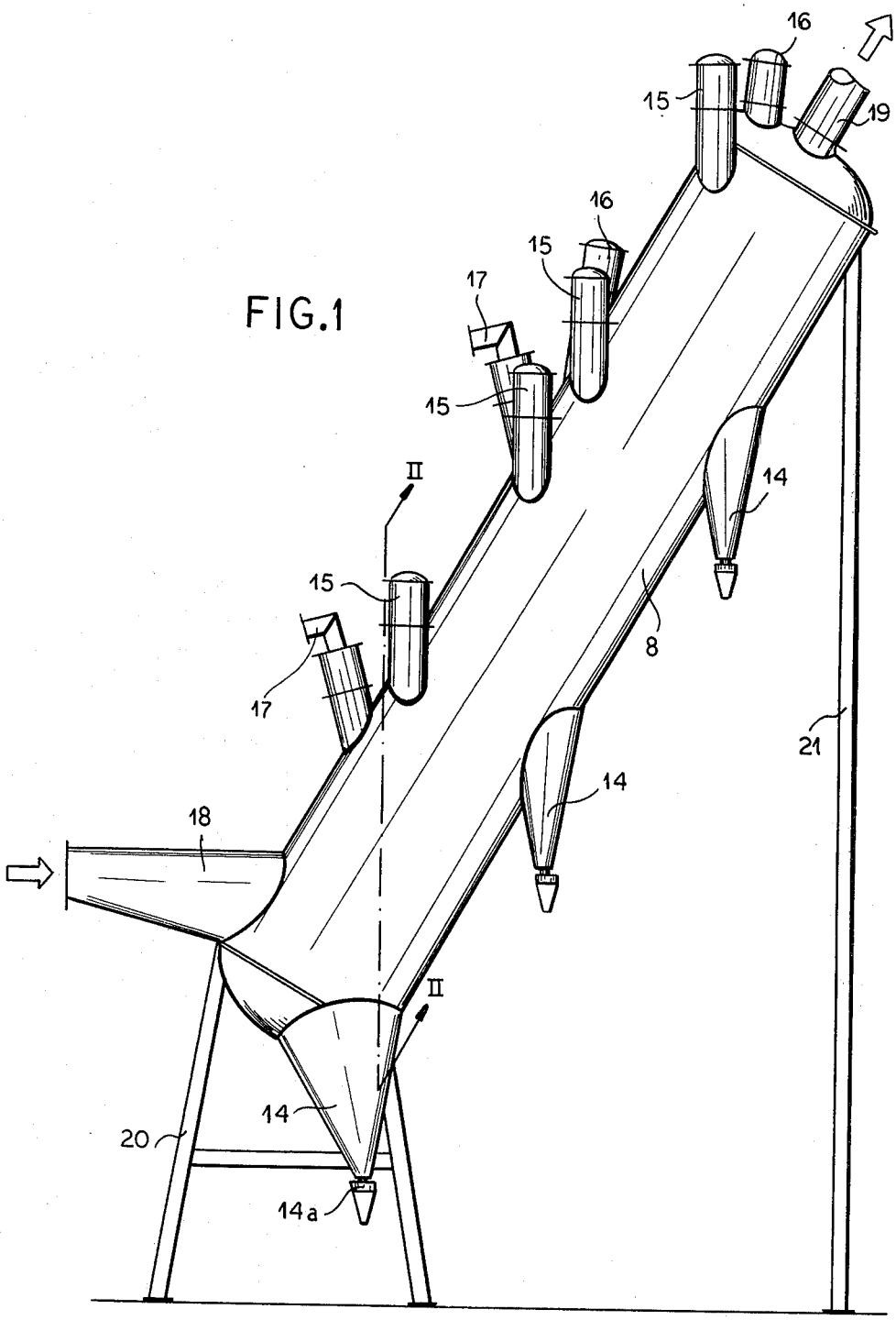
FIG. 1 is a highly diagrammatic side-elevational view showing a high-temperature, high-pressure electrostatic precipitator according to the invention.

FIG. 1 shows an inclined precipitator housing 8, which is supported by a carrying structure 20, 21.

The precipitator housing 8, which has the form of a duct, is provided with a generally horizonal gas-inlet pipe 18 at the lower end and axially extending gas-outlet pipe 19.

Dust bins 14 with discharge devices 14*a* (represented diagrammatically) are provided on the underside of the precipitator housing.

Housings 15, 16, 17 are mounted on top of the precipitator housing 8 and accommodate the insulators 7 for carrying the corona discharge electrode system.

Figure 3:
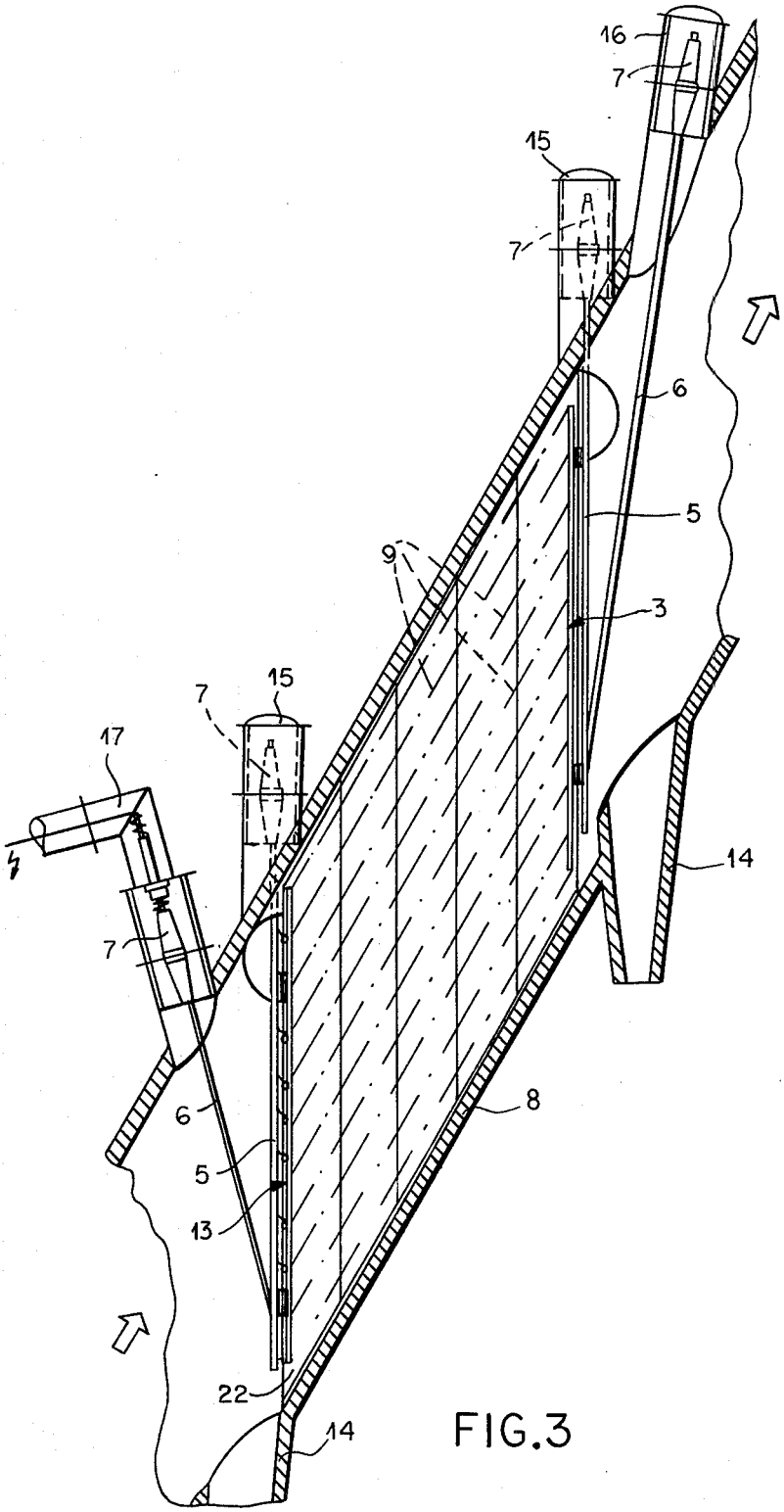
FIG. 3 is a fragmentary sectional view taken along section line III—III in FIG. 2.

The housings 15 are associated with vertical carriers 5 (see FIG. 3). The housings 16 are associated with the inclined carriers 6, which are directed upwards out of the collection region in the direction of gas flow. The housings 17 are associated with the inclined carriers 6, which are directed upwards out of the system opposite to the direction of gas flow, i.e. the carriers 6 of housings 16 and 17 diverge (see FIG. 3). High voltage is applied through housings 17.

Figure 2:
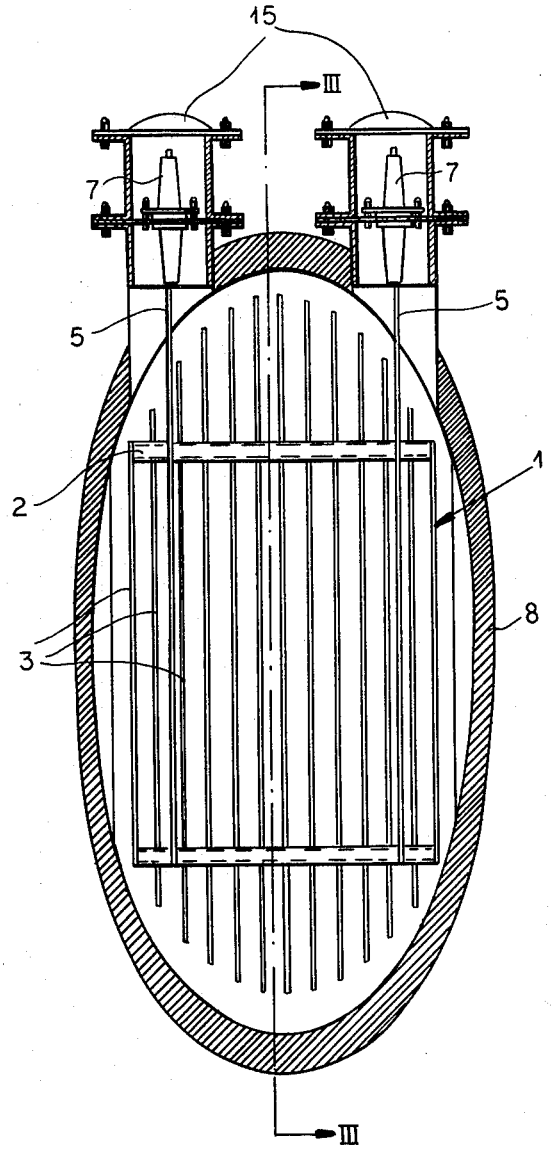
FIG. 2 is an enlarged vertical sectional view taken along section line II—II of FIG. 1.

The precipitator housing has an elliptical contour in the vertical sectional view shown in FIG. 2. The housings 15 contain the insulators 7 for vertically supporting the gridlike frame 1 by means of the carriers 5. The frame 1 consists of two horizontal main carriers 2 and a plurality of vertical auxiliary carriers 3.

The fragmentary sectional view of FIG. 3 indicates how the corona discharge electrode field is supported.

Platelike collecting electrodes 22 extend substantially parallel to the direction of gas flow in vertical planes and divide the entire flow area into discrete passages, in which the tensioned corona discharge electrodes 9 extend parallel to the direction of gas flow.

The corona discharge electrodes 9 are secured to the upper vertical auxiliary carriers 3 and pass over elements on the lower auxiliary carriers 13 and tensioned by weights. See FIGS. 4A–4F.

The auxiliary carriers 3, 13 and the main carriers 2 constitute frames, which are suspended in the housings 15 by means of vertical carriers 5 and interposed insulators and are spaced a predetermined distance apart by means of inclined carriers 6, which are directed out of the region and are secured in the housings 16 and 17 by insulators 7.

The angle between the carriers 5 and 6 is so selected that the weight and the tensile forces of the corona discharge electrode system can be taken up without a rigid connection between the frames. High voltage is applied through the housing 17. Dust-collecting bins 14 are provided on the underside of the precipitator housing 8.

Various arrangements comprising weights 10 for tensioning the corona wires 9 are shown in FIGS. 4A–4F. In all of these FIGURES the vertical auxiliary carrier is designated 13.

Figure 4A:
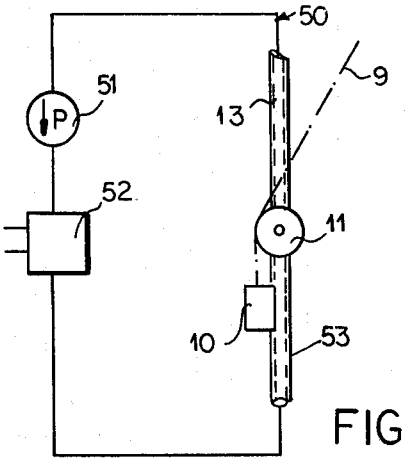
FIGS. 4A–4F are diagrams which show details of the means for tensioning the corona-discharge electrodes.

In accordance with FIG. 4A, the corona wire 9 is guided around a pulley 11, which is rotatably mounted on the auxiliary carrier 13, and is tensioned by a weight 10 which is secured to the corona wire 9. The center of mass of weight 10 is thus offset from the pulley axis.

Figure 4B:
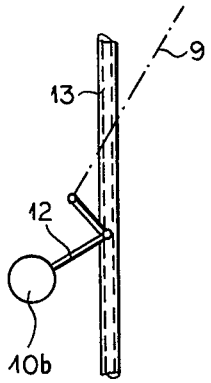

In accordance with FIG. 4B, the corona wire 9 is secured to one arm of a bell-crank lever 12 and a weight 10*b* for tensioning the corona wire is carried by the other arm of the lever, which is fulcrumed between these arms to the auxiliary carrier 13.

Figure 4C:
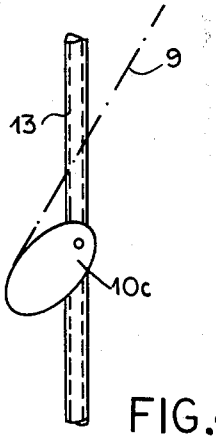

In accordance with FIG. 4C, the corona wire 9 is directly connected to an elliptical weight 10*c*, whose center of mass is offset from the pivot by which this weight is rotatably mounted on the auxiliary carrier 13.

Figure 4D:
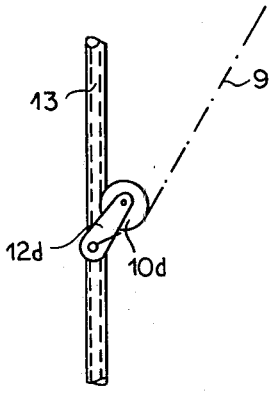

In FIG. 4D, the weight 10*d* consists of a pulley, which is pivoted to the auxiliary carrier 13 by a lever 12*d*. The corona wire 9 is secured in this case at the pivoted axis or fulcrum.

Figure 4E:
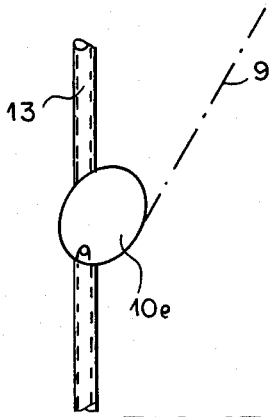
Figure 4F:
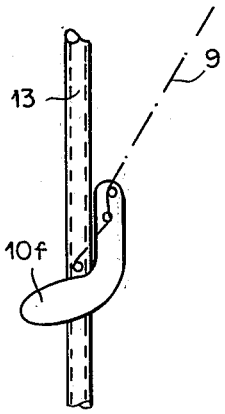

In FIG. 4E, the corona wire 9 is also secured at the pivot and an elliptical weight 10*e* is provided. In accordance with FIG. 4F the corona wire 9 is secured directly to the auxiliary carrier 13 and an angled weight 10*f* having two wire-deflecting pins is suspended from the wire to tension the same.

As can be seen from FIG. 4A, the members 13 of the frame, like all of the members of the upper and lower frames can be hollow and connected in a closed circulating system 50 for a coolant, this system including a pump 51 and a heat exchanger 52 for removing heat from the coolant which can be water. The external surfaces 53 of the members are coated with a ceramic such as alumina or other thermally insulating material while the tensioning members 10, 10*b*–10*f*, 11, 12 and 12*d* can be composed of ceramic as well.

We claim:

1. An electrostatic precipitator operable at elevated temperatures and pressures, comprising:

an upwardly inclined elongated housing forming a gas-flow duct provided with a gas inlet and a gas outlet and inclined at an angle of substantially 50° to 70° to the horizontal and defining at least one dust-collection zone therein, said housing being traversed upwardly by gas in a flow direction from said gas inlet to said gas outlet;

an array of vertical plate-like collecting electrodes in horizontally spaced mutually parallel relationship extending over the length of said at least one zone; and a corona discharge electrode system in said housing for charging dust particles entrained in a gas traversing said at least one zone for collection of said dust on said collecting electrodes, said system comprising:

a pair of grid like frames disposed at opposite ends of said zone in said housing and spaced apart in the gas flow direction, said frames including an upper frame at a downstream location with respect to said direction and a lower frame at an upstream location with respect to said direction, each of said frames comprising a pair of vertically spaced horizontal main carriers and a plurality of mutually parallel horizontally spaced vertical auxiliary carriers whereby said upper frame has upper vertical auxiliary carriers and said lower frame has lower vertical auxiliary carriers, a respective carrier structure for each of said frames and comprising a pair of vertical struts connected to a respective frame, and a pair of inclined struts each connected at its lower end to one of said vertical struts, the inclined struts of said carriers being directed upwardly and outwardly away from said zone with the angle between the inclined struts and the vertical struts being such that the weight and tensile forces of said system are taken up without rigid connection of said frames together, respective insulators at the upper ends of each of said struts for suspending same on said housing, a multiplicity of elongated corona discharge electrodes extending between said collecting electrodes parallel to the direction of gas flow and secured to the upper vertical auxiliary carriers, and a respective weight engaging lower portions of each of said corona discharge electrodes and at said lower vertical auxiliary carriers and forming means for tensioning said corona discharge electrodes against said lower vertical auxiliary carriers.

2. The electrostatic precipitator defined in claim 1 wherein said corona discharge electrodes are wires.

3. The electrostatic precipitator defined in claim 2 wherein said wires are guided over members mounted on said lower vertical auxiliary carriers.

4. The electrostatic precipitator defined in claim 3 wherein said members are pulleys.

5. The electrostatic precipitator defined in claim 3 wherein said weights are pivotally mounted on said lower vertical auxiliary carriers and having centers of gravity eccentric to their respective pivots to form said members.

6. The electrostatic precipitator defined in claim 2 wherein said wires are engaged by weighted levers forming said weights and fulcrumed on said lower vertical auxiliary carriers.

7. The electrostatic precipitator defined in claim 1, claim 2, claim 3, claim 4, claim 5 or claim 6 wherein said frames are composed at least in part of tubular members forming a closed flow system, further comprising means for circulating a coolant through said closed flow system.

8. The electrostatic precipitator defined in claim 7 wherein said members of said frames are provided with external coatings of heat-insulating material.

9. The electrostatic precipitator defined in claim 1, claim 2, claim 3, claim 4, claim 5 or claim 6 wherein the means for tensioning said corona discharge electrodes and engaging same at said lower vertical auxiliary carriers are composed at least in part of ceramic material.

* * * * *